US007554304B2

(12) United States Patent
Kruiskamp et al.

(10) Patent No.: US 7,554,304 B2
(45) Date of Patent: Jun. 30, 2009

(54) LOW DROPOUT VOLTAGE REGULATOR FOR SLOT-BASED OPERATION

(75) Inventors: Marinus Wilhelmus Kruiskamp, 'S-Hertogenbosch (NL); Corneles René Beumer, 'S-Hertogenbosch (NL)

(73) Assignee: Sitel Semiconductor B.V., 'SHertogenbosch (NL)

( * ) Notice: Subject to any disclaimer, the term of this patent is extended or adjusted under 35 U.S.C. 154(b) by 126 days.

(21) Appl. No.: 11/680,862

(22) Filed: Mar. 1, 2007

(65) Prior Publication Data

US 2007/0236190 A1 Oct. 11, 2007

(30) Foreign Application Priority Data

Mar. 3, 2006 (EP) ..... 06110616

(51) Int. Cl.
*G05F 1/40* (2006.01)
*G05F 1/44* (2006.01)

(52) U.S. Cl. ..... 323/272; 323/273; 323/282; 323/284

(58) Field of Classification Search ..... 323/272, 323/273, 274, 282, 284
See application file for complete search history.

(56) References Cited

U.S. PATENT DOCUMENTS 5,852,359 A * 12/1998 Callahan et al. ..... 323/274
5,953,256 A 9/1999 Briner
6,046,577 A 4/2000 Rincon-Mora et al.
6,181,118 B1 1/2001 Meehan et al.
6,201,375 B1 * 3/2001 Larson et al. ..... 323/277
6,388,433 B2 * 5/2002 Marty ..... 323/284
6,441,594 B1 * 8/2002 Connell et al. ..... 323/274
6,448,750 B1 * 9/2002 Shor et al. ..... 323/282
6,768,371 B1 7/2004 Layton et al.

OTHER PUBLICATIONS

Hasler, et al., "Programmable Low Dropout Voltage Regulator", System-on-Chip for Real-Time Applications, 2005., Proccedings. Fifth International Workshop on BANFF, AB, Canada Jul. 20-24, 2005, pp. 459-462, Piscataway, NJ.
Low, et al., "Basics of Floating-Gate Low-dropout Voltage Regulators", Circuits and Systems, 2000. Proceedings of the 43rd IEEE Midwest Symposium on Aug. 8-11, 2000, pp. 1048-1051, vol. 3, Piscataway, NJ.

* cited by examiner

*Primary Examiner*—Bao Q Vu
(74) *Attorney, Agent, or Firm*—Sughrue Mion, PLLC

(57) ABSTRACT

Voltage regulator for providing an output voltage (Vout) to a load (Zload) having an output transistor (T1), an operational amplifier (OA), and a first reference voltage source (VS). The negative input of the operational amplifier (OA) is connected to a feedback line (FL) to receive an input voltage derived from the output voltage. The first reference voltage source (VS) provides a reference voltage (Vref) to the positive input (IN2) of the operational amplifier (OA). The output (O1) of the operational amplifier (OA) is connected to a floating voltage source (FVS; C1). The other side of the floating voltage source is connected to a gate terminal (G) of the output transistor (T1). The floating voltage source (FVS) provides a voltage level (Vg) at the gate terminal of the output transistor (T1) higher than the output voltage of the operational amplifier (OA).

16 Claims, 4 Drawing Sheets

LOW DROPOUT VOLTAGE REGULATOR FOR SLOT-BASED OPERATION

FIELD OF THE INVENTION

The present invention relates to a low dropout voltage regulator.

BACKGROUND OF THE INVENTION

A low dropout voltage regulator (LDO) is a widely used circuit in electronic systems. The purpose of the LDO is to generate a constant output voltage as supply for other circuits in the electronic system and to isolate these circuits from each other to reduce cross talk via an external supply voltage. The dropout voltage can be defined as the minimum voltage over the regulator to substantially maintain its output voltage.

LDOs may be integrated on a semiconductor substrate in a so-called system-on-chip to save costs and to improve performance.

FIG. 1 shows a schematic layout of an LDO which is capable of providing a constant voltage supply for an electronic circuit. The electronic circuit is schematically depicted by a resistor Zload.

The LDO depicted in FIG. 1 has an output transistor T1, controlled by a feedback loop with an operational amplifier OA.

In this example an nMOS transistor T1 is connected with a drain terminal D to an external voltage supply Vsup. A gate terminal G of transistor T1 is connected to an output O1 of the opamp OA. A source terminal S of transistor T1 has a connection to a first negative input IN1 of the opamp OA.

External voltage supply Vsup is also connected to a power supply terminal IN3 of the opamp OA.

The source terminal S is further connected to a supply terminal X1 of the electronic circuit Zload. A second terminal X2 of Zload is connected to a ground potential line Vgnd. Parallel to the circuit Zload a capacitor Cload is connected between the source terminal S and ground potential Vgnd.

Further, a reference voltage signal Vref is provided to a second input of the opamp OA by a reference voltage source VS, which has one terminal connected to the second positive input IN2 of the opamp OA and the other terminal connected to ground potential Vgnd.

Adversely, the output voltage of the opamp OA at terminal O1 is a gate-source voltage above the output voltage Vout as measured on the source side S of the nMOS transistor T1. Assuming that the output O1 is limited by the supply voltage IN3, this implies that the LDO of FIG. 1 can not have a low dropout voltage, which poses a disadvantage in battery-powered circuits.

Many variations on the basic LDO of FIG. 1 exist.

For example, in one further type of LDO instead of an nMOS output transistor T1, a pMOS transistor is used as output transistor. In such an LDO, the output impedance will increase with frequency due to the roll-off of the control loop. A large external capacitor Cload (compared to the capacitor required in an LDO based on an nMOS transistor) is needed to maintain a low output impedance for high frequencies. The need for this large capacitor is a major drawback of this kind of LDO. Each LDO requires a dedicated pin for the capacitor. This adds significantly to costs especially in situations where many circuits each comprise a pMOS transistor based LDO.

In another type of nMOS transistor based LDO as described in e.g., G. den Besten, B. Nauta, "Embedded 5V-to-3.3V Voltage Regulator for Supplying Digital IC's in 3.3V CMOS Technology," IEEE J. Solid-State Circuits, vol. 33, July 1998, pp. 956-962, the opamp OA is replaced by a charge pump circuit. The charge pump circuit is capable of driving the gate of the output transistor to a voltage above the supply voltage Vsup. Thus, such an LDO can have a low dropout voltage. Disadvantageously, this type of LDO provides an output voltage which is not constant due to electronic properties of the charge pump: the charge pump can generally not react as fast as an opamp OA, so a sudden change in external supply or in load impedance will result in a larger distortion than would occur in the case of the standard nMOS transistor based LDO voltage regulator. Moreover, the charge-pump uses a clock to generate the high voltage: the output voltage of the charge pump shows small voltage steps instead of having a constant level. The output voltage Vout of the LDO will follow these steps, i.e., shows a ripple, and will not be constant.

Another type of LDO as disclosed in U.S. Pat. No. 5,162,668 is based on an nMOS transistor with an opamp OA combined with a charge pump. Again, due to the properties of the charge pump, the output voltage Vout of such an LDO may still show a ripple, which hinders application in sensitive analog circuits.

The prior art also discloses cascading of different types of LDOs. An example of a cascaded voltage regulator has been described in V. Gupta, G. Rincon-Mora, "A Low Dropout, CMOS Regulator with High PSR over Wideband Frequencies," in Proc. ISCAS2005, 2005, pp. 4245-4248, which shows a pMOS based LDO in cascade with a charge-pump driven nMOS based LDO. In this type of LDO circuit the series connection of the pMOS and nMOS transistor does however adversely increase the dropout voltage. In addition, the cascade causes a generation of a cross-talk signal from the charge pump to the pMOS transistor that may interfere with the output voltage Vout.

Due to the possibility for integration on-chip in semiconductor devices, LDOs are potentially well suited for digital wireless communication applications. In many systems based on digital wireless communication (for instance GSM, DECT, Bluetooth, IEEE 802.11), communication only takes place in certain time-slots within a time frame. For the reason of power-saving, a receiver is designed to be powered-down as much of the time as possible. This means that during each time frame, there will be one or more periods that receiver-related circuits are in power-down mode and a constant supply voltage is not needed.

It is an object of the present invention to provide a low dropout voltage regulator which is capable of delivering a substantially constant output voltage especially in time-slot based operation devices.

SUMMARY OF THE INVENTION

The present invention relates to a low dropout voltage regulator for providing an output voltage to a load comprising an output transistor, an operational amplifier, a floating voltage source, and a first reference voltage source; the output transistor being connected via a drain terminal to a voltage supply, and via a source terminal being connectable to a supply terminal of the load; a first input of the operational amplifier being connected to a feedback line to receive an input voltage derived from said source terminal; the first reference voltage source being arranged for providing a reference voltage to a second input of the operational amplifier; an output of the operational amplifier being connected for providing an output voltage to a first terminal of the floating voltage source, and a second terminal of the floating voltage source being connected to a gate terminal of the output transistor; the floating voltage source being arranged for providing a voltage level at the gate terminal of the output transistor higher than said output voltage of said operational amplifier.

Advantageously, by increasing the level of the output voltage of the operational amplifier by means of the floating voltage source, the voltage applied on the gate can be increased to a level above the supply voltage. In that case, the voltage regulator is capable of providing a low dropout voltage.

In an embodiment, the invention relates to a semiconductor device comprising such a voltage regulator.

According to one embodiment, the invention provides a method of time-slot based operation for a voltage regulator for providing an output voltage to a load, the voltage regulator comprising an output transistor, an operational amplifier, a floating voltage source and a first reference voltage source;

the output transistor being connected via a drain terminal to a voltage supply, via a source terminal to a supply terminal of the load;

a first input of the operational amplifier being connected to a feedback line to receive an input voltage derived from said source terminal;

the first reference voltage source being arranged for providing a reference voltage to a second input of the operational amplifier;

an output of the operational amplifier being connected for providing an output voltage to a first terminal of the floating voltage source, and a second terminal of the floating voltage source being connected to a gate terminal of the output transistor;

the floating voltage source being arranged for providing a voltage level at the gate terminal of the output transistor higher than said output voltage of said operational amplifier, and the floating voltage source being a storage capacitor, the first terminal of the storage capacitor also being connected to a first terminal of a first switching element and a second terminal of the first switching element being connected to ground potential;

the second terminal of the storage capacitor further being connected to a first terminal of a second switching element, a second terminal of the second switching element being connected to a positive terminal of a second reference voltage source and a second terminal of the second reference voltage source being connected to ground potential;

the first and second switching elements being closed during a power-down mode of the voltage regulator, wherein at a power-down period, said first and second switching elements are closed;

at a pre-charge step at a first time t0, the second switching element is opened;

at a power-on step at a second time t1, the first switching element is opened, with t1>t0.

BRIEF DESCRIPTION OF DRAWINGS

The invention will be explained in more detail below with reference to a few drawings in which illustrative embodiments of the invention are shown.

DETAILED DESCRIPTION OF EMBODIMENTS

Figure 1:
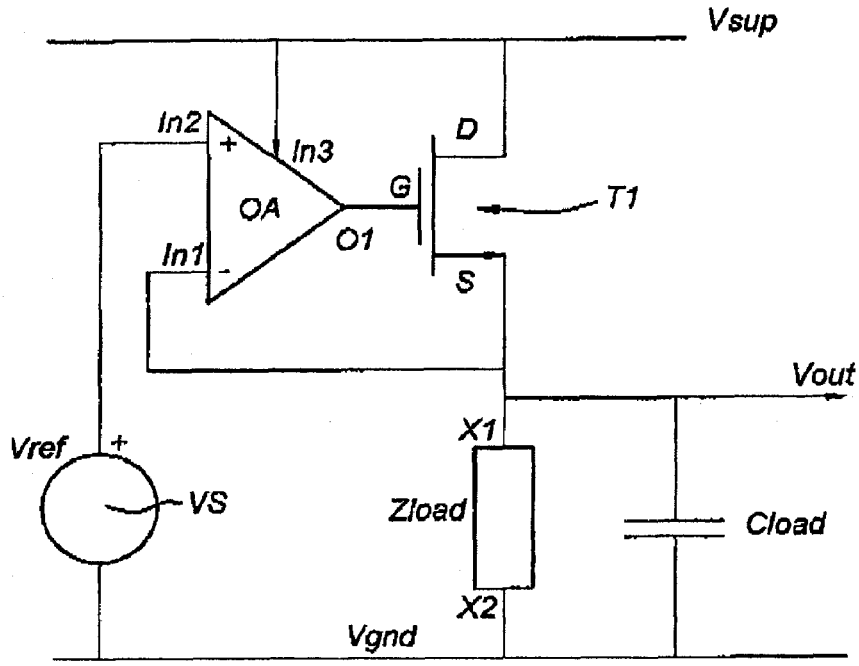
Fig 1 Prior art
FIG. 1 shows a schematic layout of an LDO according to the prior art.

In the present invention it is recognized that the level of the dropout voltage of the LDO can be reduced in comparison to what is achievable by the LDO of the prior art as shown in FIG. 1.

The dropout voltage level is reduced by increasing the level of the output voltage of the opamp OA (i.e., the gate voltage of the transistor) relative to the supply voltage Vsup by superposition of a floating voltage on the output voltage from the opamp OA, as will be explained in detail hereinafter. Throughout all figures, the same reference signs and numbers refer to the same components/entities.

Figure 2:
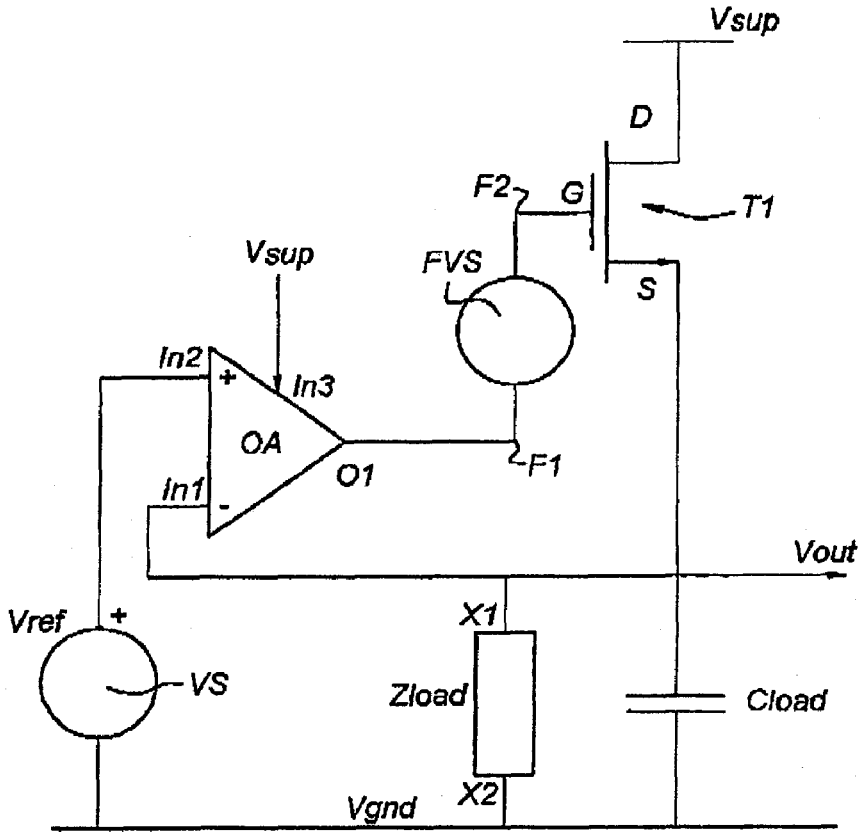
FIG. 2 shows a schematic layout of an LDO according to the present invention.

FIG. 2 shows a schematic layout of an LDO according to the present invention in which a floating voltage source FVS is connected in series with the output terminal O1 of the opamp OA on one terminal F1 of the floating voltage source FVS and with the gate terminal G of the nMOS transistor T1 on an other terminal F2 of FVS. The floating voltage source FVS provides a voltage Vref2, which increases the voltage on the gate terminal G of the MOS transistor T1. The floating voltage source FVS and its voltage Vref2 are chosen in such a way that the output voltage of the opamp OA is within its output range when the LDO is active. By increasing the level of the output voltage of the opamp OA, advantageously the voltage applied on the gate G can be increased to a level above the supply voltage Vsup. In that case, the LDO is capable of providing a low dropout voltage.

Moreover, the LDO can have a low-ohmic output over a large frequency range due to the nMOS source follower structure (similar to the regular nMOS regulator from the prior art as shown in FIG. 1).

Figure 3:
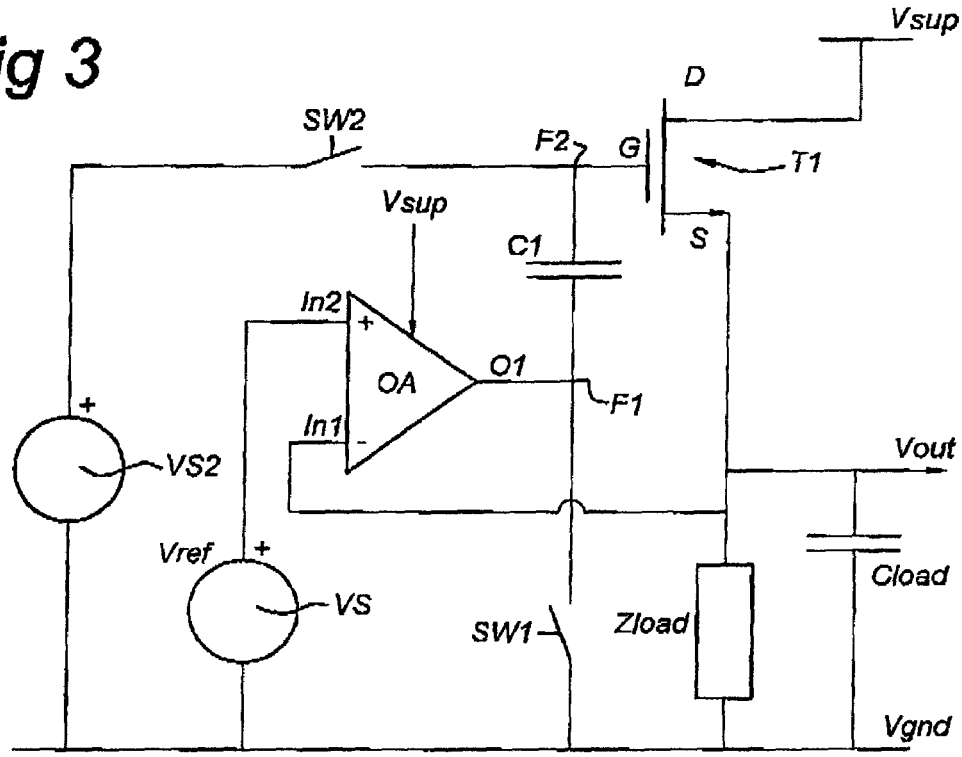
FIG. 3 shows a schematic layout of an LDO according to an embodiment of the present invention.

FIG. 3 shows a schematic layout of an LDO according to an embodiment of the present invention.

In FIG. 3 entities with the same reference number refer to identical entities as shown in the preceding figures.

In the circuit of FIG. 3, the output transistor T1 is an nMOS transistor controlled by a feedback loop with the opamp OA in series with a storage capacitor C1 which acts as the floating voltage source. The feedback loop is similar to the one shown in FIG. 1. In this embodiment, the output O1 of the opamp OA is connected to the first terminal F1 of the storage capacitor C1. The storage capacitor C1 has its second terminal F2 connected to the gate terminal G of the nMOS transistor T1.

The first terminal F1 of the storage capacitor is further connected to a terminal of a first switching element SW1. The other terminal of the first switching element SW1 is connected to Vgnd.

Between Vgnd and the gate terminal G of the nMOS transistor T1 a second reference voltage source VS2 is connected. One terminal of the second reference voltage source VS2 is connected to Vgnd. The other terminal of the second reference voltage source VS2 is connected to a terminal of a second switching element SW2. The other terminal of the second switching element SW2 is connected to the second terminal F2 of the storage capacitor C1 and the gate terminal G of the nMOS transistor T1.

The first and second switching elements SW1, SW2 are controlled in such a way that when the LDO is in power-down mode, the switching elements SW1 SW2 are closed. In that case the storage capacitor C1 is connected in parallel to the second reference voltage source VS2: the storage capacitor C1 is charged to the voltage level Vref2 of the second reference voltage source VS2.

The switching elements SW1, SW2 can be any type of switching element that can be integrated on a semiconductor substrate.

When the LDO is in its active mode (i.e., must provide the output voltage Vout to the external circuit Zload), the switching elements SW1 and SW2 are opened. In that case the second reference voltage source VS2 is disconnected from the storage capacitor C1. The storage capacitor C1 which had been charged to the voltage level Vref2 during power-down mode, now provides a voltage Vc in superposition to the output voltage on output O1.

During active mode of the LDO, the storage capacitor C1 will gradually discharge and the voltage Vc of the storage capacitor C1 will decrease at a corresponding rate. By selecting a suitable capacitance in relation to the maximum leakage current at node F2 and of the duration of active-and power-down modes, a sufficiently high value Vc can be maintained during an active mode of the LDO.

Figure 4:
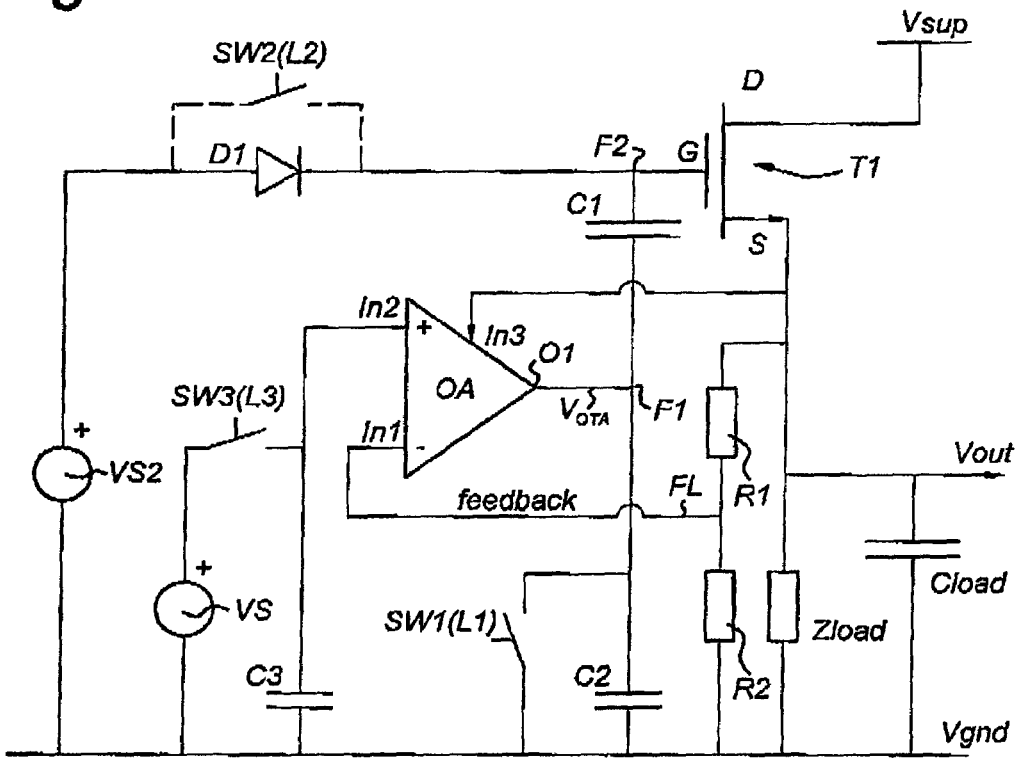
FIG. 4 shows a schematic layout of an LDO according to yet another embodiment of the present invention.

FIG. 4 shows a schematic layout of an LDO according to yet another embodiment of the present invention. In FIG. 4 entities with the same reference number refer to identical entities as shown in the preceding figures.

The differences with FIG. 3 are as follows.

A resistor divider comprising a first resistor R1 and a second resistor R2 is provided in parallel to load Zload. A first terminal of first resistor R1 is connected to source S. A second terminal of the first resistor R1 is connected to the first negative input IN1 of the opamp OA via a feedback line FL and is further connected to a first terminal of a second resistor R2. A second terminal of the second resistor R2 is connected to ground potential Vgnd.

The gate terminal G of the nMOS transistor T1 is connected to a first terminal of the second switching element SW2 ("pre-charge"). The second switching element SW2 is controllable by a second logical signal L2 ("pre-charge"). A second terminal of the second switching element SW2 is connected to a positive terminal of the second reference voltage source VS2. A negative terminal of the second reference voltage source VS2 is connected to ground potential Vgnd.

A second capacitor C2 is provided in parallel to first switching element SW1. The purpose of the second capacitor C2 is to keep the output voltage of the opamp OA stable at frequencies above the roll-off frequency of the opamp OA. The second capacitor C2 significantly improves the high frequency power supply rejection, but optionally may be omitted, like in the arrangement according to FIG. 3. The first switching element SW1 is controllable by a first logical signal L1 ("power-down").

The second positive input IN2 of the opamp OA is connected to a third switching element SW3 ("sampling") and also to a first terminal of a third capacitor C3. A second terminal of the third capacitor C3 is connected to ground potential Vgnd. The third switching element SW3 is controllable by a third logical signal L3 ("sampling").

A second terminal of the third switching element SW3 is connected to a positive terminal of the reference voltage source VS. A negative terminal of the reference voltage source VS is connected to ground potential Vgnd.

The voltage on the gate terminal G of the nMOS transistor T1 is indicated as Vg. The voltage carried by the output O1 of the opamp OA is indicated as Vota. The voltage on the feedback line FL between the resistive voltage divider R1, R2 and the negative input IN1 of the opamp OA is indicated as Vfb.

The opamp OA (at input IN3) is supplied with the output voltage Vout of the LDO, i.e., the source terminal S of the nMOS transistor T1 (instead of the external supply Vsup, as shown in FIG. 1). This has the advantage of an improved power supply rejection. During power-down, the output voltage Vout of the source terminal S will be Vref2 minus the gate G—source S voltage Vgs of the nMOS output transistor T1 (Vout≡Vref2−Vgs). Generally, Vref2 can be selected such that this voltage is sufficient for the opamp OA to operate.

The reference voltage Vref of the reference voltage source VS is sampled when the LDO is active (the third switching element SW3 is closed in active mode). This sampling prevents that noise and distortion on the reference voltage Vref influence the output voltage of the LDO (voltage on the source terminal S). This sampling is allowed since the LDO will be active only a limited time (short enough to neglect leakage of the sampled voltage).

The second switching element SW2 between the second reference voltage source VS2 and the storage capacitor C1 can be implemented as either a diode D1 or the switch SW2. In case of an application of the diode D1, Vref2 as provided by the second reference voltage source VS2 has to be increased by the forward voltage of the diode D1 for the connection between the second reference voltage source VS2 and the storage capacitor C1 to become conductive.

In case of an application of the switch SW2, the signal L2 "pre-charge" has to become low, before the active mode commences, to be sure that Vref2 is sampled on the storage capacitor C1, i.e., that the storage capacitor C1 is charged by the second reference voltage source VS2.

The negative input IN1 of the opamp OA is connected via resistive voltage divider R1, R2, comprising the first and second resistors R1, R2, to the output of the source terminal S of the output transistor T1. This is because the reference voltage Vref is usually lower than Vout.

The opamp OA may be implemented as an nMOS differential transistor pair, loaded by a pMOS transistor current mirror. For improved performance, it is possible to cascade both the differential transistor pair and the transistor current mirror.

Figure 5:
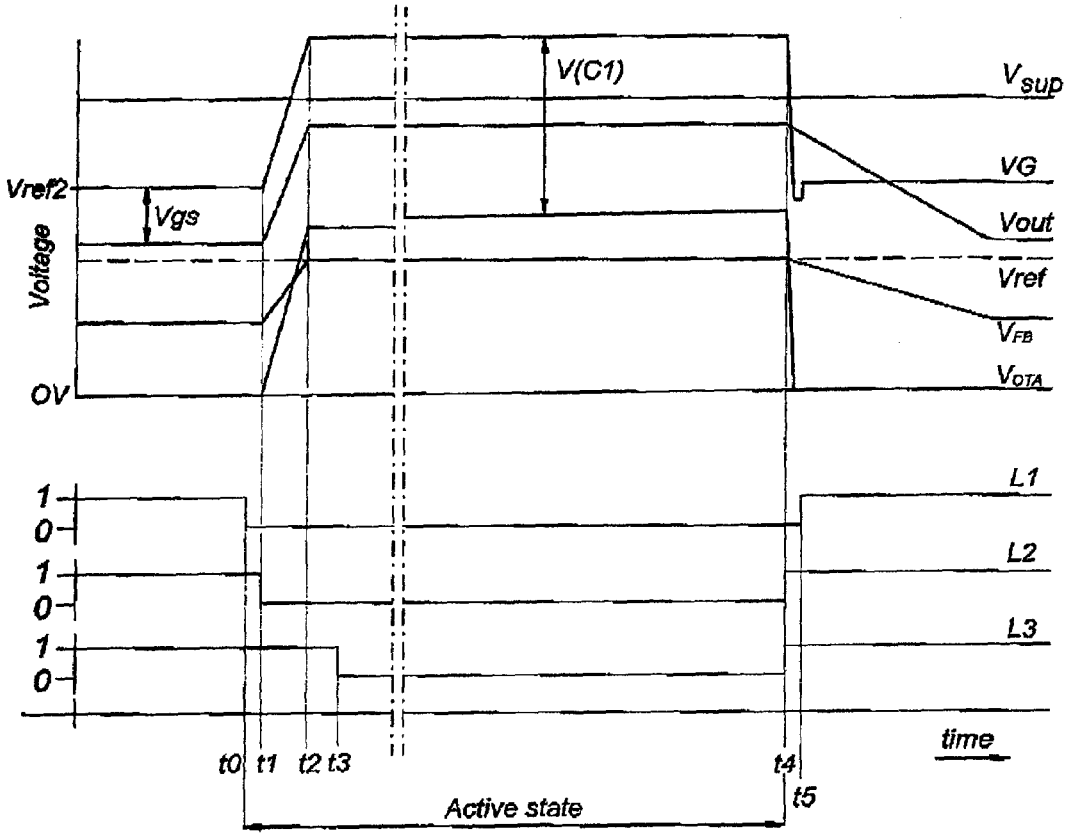
FIG. 5 shows a timing diagram of signals in an LDO according to the present invention.

FIG. 5 shows a timing diagram of signals in the LDO of FIG. 4.

In the diagram of FIG. 5, on the horizontal axis a course of time is plotted.

In the upper part of the diagram on the vertical axis, a voltage level of signals Vsup, Vg, Vout, Vref, Vfb, Vota, in the LDO is plotted.

In the lower part of the diagram, a logical level of the logical control signals of first, second and third switching elements SW1, SW2, SW3 is plotted as a function of time. The logical signals of the first, second and third switching element SW1, SW2, SW3 are indicated by L1, L2, and L3 respectively.

Initially, all three switching elements SW1, SW2, SW3 ("power-down", "pre-charge" and "sample") are in a closed state, i.e., the first, second and third logical signals L1, L2, L3 are each on a logical level "1" and the switching elements SW1, SW2, and SW3 are conducting.

Since the storage capacitor C1 and the gate terminal G of the nMOS output transistor T1 are both connected to the second reference voltage source VS2, the voltage on capacitor C1 and gate G, respectively, is substantially equal to the floating voltage Vref2 as defined by the second reference voltage source VS2.

The third capacitor C3 is connected in parallel to the reference voltage source VS, the voltage on the third capacitor C3 is substantially equal to the reference voltage Vref as defined by the reference voltage source VS.

Since the nMOS output transistor T1 behaves as a source follower, the output voltage Vout of the nMOS transistor T1 equals a gate-source voltage Vgs below the gate voltage Vg. The output voltage Vout of the nMOS transistor T1 acts as supply voltage for the opamp OA.

To activate the LDO, first the second switching element SW2 ("pre-charge") is opened: second logical signal L2 changes from "1" to "0" at time t0. The charge on the storage capacitor C1 is now isolated and the storage capacitor C1 behaves as a floating voltage source providing a substantially constant voltage.

Next, at time t1 the first switching element SW1 ("power-down") is opened (first logical signal L1 changes from "1" to "0"), allowing the opamp OA to control the gate of the nMOS transistor T1 via storage capacitor C1. The voltage Vfb on the negative input IN1 of the opamp OA is lower than the voltage Vref on the positive input IN2, so the output voltage Vout of the opamp OA will show an increase at time t1.

The gate voltage Vg of the gate G of the nMOS transistor T1 will follow due to the connection over the storage capacitor C1 (which is a floating voltage at level Vref2). The output voltage Vout of the nMOS transistor T1 will follow due to its source follower behavior. The feedback loop will settle when the feedback signal Vfb is equal to the reference voltage Vref. This point is reached at time t2.

From time t2, the LDO is in regulation, maintaining a substantially constant output voltage Vout.

Next at time t3, the third switching element SW3 ("sample") is opened (third logical signal L3 changes from "1" to "0"), to isolate the LDO from noise and/or disturbance on the reference voltage Vref as provided by the reference voltage source VS. The input IN2 of the opamp OA is now supplied with the voltage on the third capacitor C3.

During operation of the LDO to provide the output voltage Vout to the external circuit Zload, leakage will cause the voltage on the storage capacitor C1 to drop, but the opamp OA will compensate for this by increasing its output voltage Vota. In the plot, starting at time t2, a gradual increase of Vota can be observed. Due to the coupling of the opamp OA and the storage capacitor C1, the gate voltage Vg remains substantially constant.

At time t4, the active state time interval t0-t4 is ended. During the active state, the low dropout voltage regulator LDO of the present invention maintained a substantially constant output voltage level Vout. At time t4, the switching elements SW1, SW2, SW3 are again closed (i.e., the respective logical levels L1, L2, L3 change from "0" to "1"). The second switching element SW2 ("pre-charge") may switch at a slightly later time t5 after time t4. The LDO now returns to its initial state. The voltage levels Vg, Vout, Vfb, Vota return to their respective initial levels as before time t0.

During a next active time slot, the switching cycle can be repeated.

Figure 6:
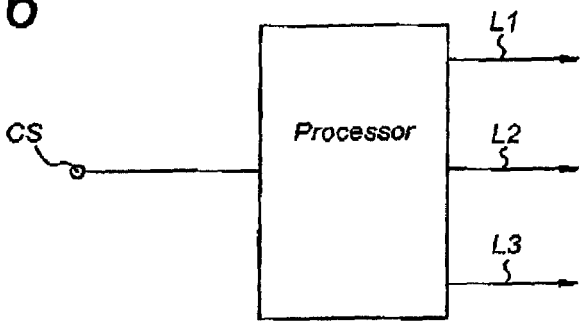
FIG. 6 shows a block diagram of a processor arranged to produce logical control signals for the arrangement of FIG. 4.

FIG. 6 shows a block diagram of the processor that produces logical signals L1, L2 and L3. The processor may receive a control signal CS (from another circuit part, not shown) that relates to a demand for supplying power to the LDO.

For example, in wireless digital communication devices transmitter and receiver circuitry may be active during time slots of a time frame to transmit and receive communication signals. The communication device may control the LDO to supply power during such active time slots to such transmitter and receiver circuitry by providing the above mentioned control signal CS to the processor that generates signals L1, L2, L3. When a control signal CS is received for enabling the processor, the processor starts operating, i.e.:

switches logical signal L2 from "1" to "0" at t0,
switches logical signal L1 from "1" to "0" at t1, and
switches logical signal L3 from "1" to "0" at t3.

The processor can be made as an integral part of the chip on which the LDO is made, by means of semiconductor components and suitable time delays. Alternatively, the processor can be a separate circuit based on either an analog, a digital or software implementation.

At the end of operation of the device, the device either switches off automatically (e.g. at the end of a telephone call) or under control of the control signal CS that now is disabling the processor. Then, at time t4 logical signals L1, L3 return to "1" and, at time t5, logical signal L2 returns to "1".

It goes without saying that a similar processor can be designed for producing logical control signals for switches SW1, SW2 in FIG. 3.

Figure 7:
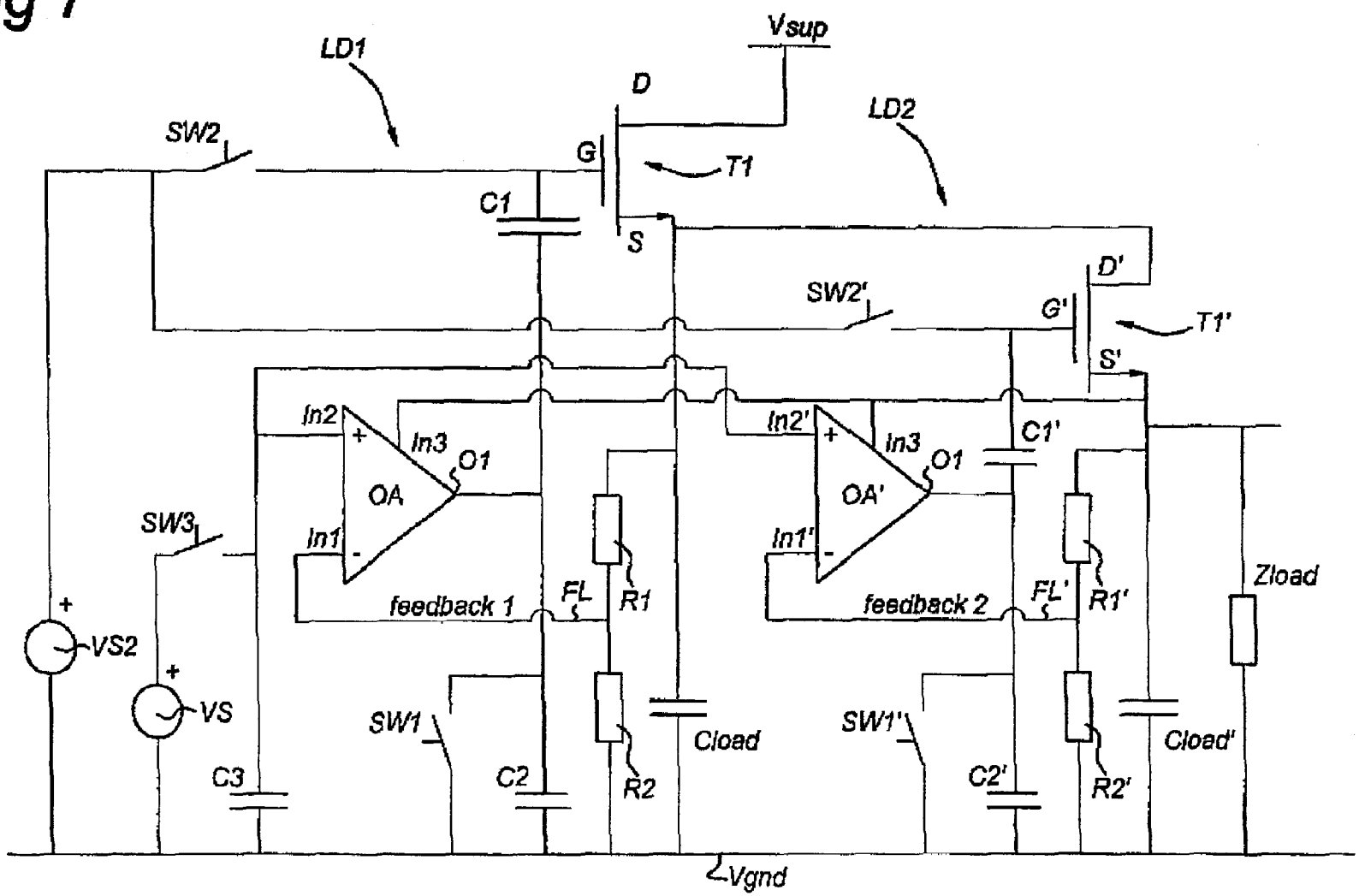
FIG. 7 shows an implementation of an LDO according to the present invention.

An implementation of a first LDO LD1 and a second LDO LD2 according to the present invention is shown in FIG. 7. Both voltage regulators LD1, LD2 are each identical to the embodiment of the LDO as shown in FIG. 4. For the first LDO LD1 the same reference numbers relate to the same entities as shown in FIG. 4. For the second LDO2 all reference numbers have been provided with a prime.

The first LDO LD1 and the second LDO LD2 are shown in a cascade connection such that the output voltage of the first LDO LD1 (via it's source of transistor T1) forms the power supply for the second LDO LD2. The output of the source S of the output transistor T1 of the first LDO LD1 is coupled to the input of the drain D' of the output transistor T1' of the second LDO LD2. The external power supply Vsup is connected to the drain D of the output transistor T1 of the first LDO LD1. The output voltage Vout' of the second LDO LD2 is supplied to the load Zload.

Further the reference voltage source VS is connected to both the input IN2 of the opamp OA in LDO LD1 and the input IN2' of the opamp OA' in LDO LD2 via switch SW3.

The second reference voltage source VS2 is connected to both the gate G in LDO LD1 and the gate G' in LDO LD2 in a similar way via switch SW2 and SW2', respectively.

In this implementation an improved suppression of disturbance of the supply voltage Vsup at Vout' can be obtained. In this set-up the first LDO LD1 is arranged for outputting an output voltage at the source S that is slightly higher than the drop-out voltage of the second LDO LD2.

It is noted that the timing of the switches SW1, SW2 and SW1', SW2' of the first LDO LD1 and the second LDO LD2, respectively may be essentially the same as shown in FIG. 5. Possibly, as will be appreciated by the skilled person the timing of the switches SW1, SW2 of the first LDO LD1 may differ slightly from that of the switches SW1', SW2' of the second LDO LD2 to prevent an undefined output voltage Vout'.

Although specific embodiments of the invention have been described, it should be understood that the embodiments are not intended to limit the invention. It will be appreciated by the person skilled in the art that other alternative and equivalent embodiments of the invention can be conceived and reduced to practice without departing from the true spirit of the invention, the scope of the invention being limited only by the appended claims.

The invention claimed is:

1. Voltage regulator for providing an output voltage (Vout) to a load (Zload), comprising an output transistor (T1), an operational amplifier (OA), a floating voltage source (FVS; C1) and a first reference voltage source (VS);

the output transistor (T1) being connected via a drain terminal (D) to a voltage supply (Vsup), and via a source terminal (S) being connectable to a supply terminal (X1) of the load (Zload);

a first input (IN1) of the operational amplifier (OA) being connected to a feedback line (FL) to receive an input voltage derived from said source terminal (S);

the first reference voltage source (VS) being arranged for providing a reference voltage (Vref) to a second input (IN2) of the operational amplifier (OA);

an output (O1) of the operational amplifier (OA) being connected to a first terminal (F1) of the floating voltage source (FVS; C1), the output of the operational amplifier being arranged for providing an output voltage to the first terminal, and the floating voltage source having a second terminal (F2) connected to a gate terminal (G) of the output transistor (T1);

the floating voltage source (FVS) being arranged for providing a voltage level (Vg) at the gate terminal of the output transistor (T1) higher than said output voltage of said operational amplifier (OA).

2. Voltage regulator according to claim 1, wherein the floating voltage source (FVS) is a storage capacitor (C1), the first terminal (F1) of the storage capacitor (C1) also being connected to a first terminal of a first switching element (SW1) and a second terminal of the first switching element (SW1) being connected to ground potential (Vgnd);

the second terminal (F2) of the storage capacitor (C1) further being connected to a first terminal of a second switching element (SW2), a second terminal of the second switching element (SW2) being connected to a positive terminal of a second reference voltage source (VS2) and a second terminal of the second reference voltage source (VS2) being connected to ground potential;

the first and second switching elements (SW1, SW2) being closed during a power-down mode of the voltage regulator.

3. Voltage regulator according to claim 2, wherein the feedback line (FL) comprises a first resistor (R1) of a resistive voltage divider (R1, R2), a first terminal of the first resistor (R1) being connected to the source terminal (S) of the output transistor (T1), a second terminal of the first resistor (R1) being connected to the first input (IN1) of the operational amplifier (OA) and being connected to a first terminal of a second resistor (R2), a second terminal of the second resistor (R2) being connected to ground potential (Vgnd).

4. Voltage regulator according to claim 2, wherein a third switching element (SW3) is provided in the connection between the second input (IN2) of the operational amplifier (OA) and the reference voltage source (VS), and wherein the second input (IN2) of the operational amplifier (OA) is further connected to a first terminal of a further capacitor (C3), the further capacitor having a second terminal connected to ground potential (Vgnd).

5. Voltage regulator according to claim 4, wherein a switching operation of at least one of the first, second, and third switching element (SW1; SW2; SW3) is controlled by a first, second and third logical signal (L1; L2; L3) respectively.

6. Voltage regulator according to claim 3, wherein the first terminal (F1) of the storage capacitor (C1) is further connected to a first terminal of a still further capacitor (C2) and a second terminal of the still further capacitor is connected to ground potential (Vgnd).

7. Voltage regulator according to claim 2, wherein the second switching element (SW2) is a diode, and the second reference voltage (Vref2) as provided by the second reference voltage source (VS2) is increased by an amount equal to a forward voltage of the diode.

8. Voltage regulator according to claim 1, wherein a third input (IN3) of the operational amplifier (OA) is connected to receive a supply voltage derived from the source terminal (S) of the output transistor (T1) for the operational amplifier.

9. A voltage regulator (LD1) according to claim 1, wherein a further voltage regulator (LD2) with a further drop-out voltage is connected in a cascade, the output of the source terminal (S) of the output transistor (T1) of the voltage regulator (LD1) providing a further voltage supply to the further voltage regulator (LD2); the output voltage at the source terminal (S) of the output transistor (T1) of the voltage regulator (LD1) being, in use, higher than the further drop-out voltage of the second voltage regulator (LD2).

10. Voltage regulator according to claim 1, integrated in a system-on-chip.

11. Semiconductor device comprising at least one voltage regulator according to claim 1.

12. Method of time-slot based operation for a voltage regulator for providing an output voltage (Vout) to a load (Zload), the voltage regulator comprising an output transistor (T1), an operational amplifier (OA), a floating voltage source (FVS; C1) and a first reference voltage source (VS);

the output transistor (T1) being connected via a drain terminal (D) to a voltage supply (Vsup), and via a source terminal (S) being connectable to a supply terminal (X1) of the load (Zload);

a first input (IN1) of the operational amplifier (OA) being connected to a feedback line (FL) to receive an input voltage derived from said source terminal (S);

the first reference voltage source (VS) being arranged for providing a reference voltage (Vref) to a second input (IN2) of the operational amplifier (OA);

an output (O1) of the operational amplifier (OA) being connected to a first terminal (F1) of the floating voltage source (FVS; C1), the output of the operational amplifier being arranged for providing an output voltage to the first terminal, and the floating voltage source having a second terminal (F2) being connected to a gate terminal (G) of the output transistor (T1);

the floating voltage source (FVS) being arranged for providing a voltage level (Vg) at the gate terminal of the output transistor (T1) higher than said output voltage of said operational amplifier (OA), and the floating voltage source (FVS) being a storage capacitor (C1), the first terminal (F1) of the storage capacitor (C1) also being connected to a first terminal of a first switching element (SW1) and a second terminal of the first switching element (SW1) being connected to ground potential (Vgnd);

the second terminal (F2) of the storage capacitor (C1) further being connected to a first terminal of a second switching element (SW2), a second terminal of the second switching element (SW2) being connected to a positive terminal of a second reference voltage source (VS2) and a second terminal of the second reference voltage source (VS2) being connected to ground potential;

the first and second switching elements (SW1, SW2) being closed during a power-down mode of the voltage regulator, wherein at a power-down period, said first and second switching elements (SW1, SW2) are closed;

at a pre-charge step at a first time (t0), the second switching element (SW2) is opened;

at a power-on step at a second time (t1), the first switching element (SW1) is opened, with t1 >t0.

13. Method of time-slot based operation for a voltage regulator according to claim 12, wherein the voltage regulator comprises a third switching element (SW3) in the connection between the second input (IN2) of the operational amplifier (OA) and the reference voltage source (VS), and at a sampling step at a third time (t3), the third switching element (SW3) is opened, with t3>t1.

14. Method of time-slot based operation for a voltage regulator according to claim 12, wherein at a fourth time (t4), at least the first and third switching elements (SW1; SW3) are closed, with t4>t3.

15. Method of time-slot based operation for a voltage regulator according to claim 12, wherein at a fifth time (t5) the second switching element (SW2) is closed, the fifth time being either simultaneous with or later than the fourth time (t4).

16. Method of time-slot based operation for a voltage regulator according to claim 12, wherein opening or closing of at least one of the first, second, and third switching element (SW1; SW2; SW3) is controlled by a first, second and third logical signal (L1; L2; L3) respectively.

* * * * *